United States Patent [19]

Stewart et al.

[11] 4,367,681

[45] Jan. 11, 1983

[54] DYNAMIC LOADING CORRECTING DEVICE

[75] Inventors: John K. Stewart, Lexington, S.C.; Charles A. Shupe, Beaconsfield, Canada; Helmuth von Beckmann, Columbia, S.C.

[73] Assignee: Canron Corp., West Columbia, S.C.

[21] Appl. No.: 338,655

[22] Filed: Jan. 11, 1982

Related U.S. Application Data

[63] Continuation of Ser. No. 956,600, Nov. 1, 1978, abandoned.

[51] Int. Cl.[3] ..... E01B 29/04

[52] U.S. Cl. ..... 104/7 B; 33/287; 73/146; 104/8

[58] Field of Search ..... 104/7 R, 7 A, 7 B, 8; 33/1 Q, 287, 338; 73/146; 360/79

[56] References Cited

U.S. PATENT DOCUMENTS

| | | | |
|---|---|---|---|
| 2,978,904 | 4/1961 | Berezhai | 73/146 |
| 3,170,100 | 2/1965 | Rantsch et al. | 360/79 X |
| 3,364,579 | 1/1968 | Fisher | 73/146 |
| 3,389,469 | 6/1968 | Plasser et al. | 104/8 |
| 3,392,451 | 7/1968 | Lombardo | 73/146 X |
| 3,604,117 | 9/1971 | von Beckmann | 33/287 |
| 3,869,907 | 3/1975 | Plasser et al. | 33/338 X |
| 3,939,331 | 2/1976 | Theurer et al. | 73/146 X |
| 4,130,062 | 12/1978 | Theurer | 104/7 R |
| 4,166,291 | 8/1979 | Shupe | 33/287 X |
| 4,176,456 | 12/1979 | von Beckmann | 33/287 X |

FOREIGN PATENT DOCUMENTS

| | | | |
|---|---|---|---|
| 253093 | 1/1971 | U.S.S.R. | 104/8 |
| 384957 | 8/1973 | U.S.S.R. | 104/8 |
| 471413 | 8/1975 | U.S.S.R. | 104/8 |

*Primary Examiner*—Randolph Reese

*Attorney, Agent, or Firm*—Wenderoth, Lind & Ponack

[57] ABSTRACT

An improved technique for correcting errors in track, for example errors in alignment and cross-level. A record of the actual geometric condition of a section of track is obtained by running a recording car operating at a predetermined speed and axle loading over the track. A record which may be on magnetic tape is thus obtained for one or more parameters such as alignment. In some cases this record may be used directly to derive electrical error signals which control a track moving device which moves the track in a direction to remove the error. Where the parameter of interest is alignment and the section of track is curved, a desired geometric condition has to be obtained for comparison with the actual geometric condition to derive the electrical error signals. One way of obtaining the desired geometric condition is to process the record to achieve a running average taken over ten or so consecutive sample points.

10 Claims, 2 Drawing Figures

DYNAMIC LOADING CORRECTING DEVICE

This is a continuation application of application Ser. No. 956,600 filed Nov. 1, 1978 now abandoned.

BACKGROUND OF THE INVENTION

This invention relates to a process for correcting railway tracks.

Such a technique is known in which a survey of a track is made and pen chart recorder makes a recording of the track representing the condition of the track before alignment. A skilled operator then takes the recording and draws a "best line" through the recorded curve to average out the errors. The corrected record is then used in a track aligning apparatus which makes use of a photocell/potentiometer/shadow board technique for aligning the surveyed track.

In another known technique an optical record is obtained during survey of the track and this can be compared with a "standard" optical record, for example by simultaneous screening. Here again, a skilled operator is necessary to interpret the differences between the actual and the ideal curves.

Both of the above techniques have the disadvantage that the alignment information fed to the track aligning machine is not mathematically accurate but is dependent on the skill and experience of the operator.

SUMMARY OF THE INVENTION

Accordingly, it is an object of the present invention to provide a technique for correcting track which is not dependent on the skill of the operator.

Another object of the invention is to provide a method of correcting a track using a record of the actual geometric conditions of the track under dynamic loading conditions.

It is a further object of the invention to provide a technique for correcting track errors in which an ideal or desired condition is compared with the actual record to derive appropriate error signals.

According to a broad aspect of the invention a method of correcting railroad track comprises obtaining a first record on a recording medium representing the actual geometric condition of at least one parameter of a length of track under predetermined dynamic loading conditions, reading the record in a track correction vehicle moving along the track in synchronism with reading of the record to derive electrical error signals indicative of the difference between the actual geometric condition and the desired geometric condition and using the error signals to control track moving means on the track correction vehicle in a direction to reduce the difference.

In the case of a straight section of track, the first record can be used to derive the error signals without any processing step but for curved sections of track where the alignment is the parameter under consideration the first record has to be processed to obtain a desired geometric condition or a desired geometric condition has to be obtained in some other way.

Thus, according to another broad aspect of the invention, there is provided a method of correcting railroad track comprising obtaining a record on a recording medium representing the actual geometric condition of a length of track, processing electronically that record to obtain a desired geometric condition of the length of track, comparing the actual geometric condition with the desired geometric condition in an electronic comparator to derive an electrical track error signal indicative of the difference between the actual geometric condition and the desired geometric condition, moving a track correction vehicle along the track in synchronism with the reading of the track error signal to control track moving means on the track correction vehicle in a direction to reduce the difference.

The desired geometric condition may be recorded on a recording medium to obtain a record of the desired geometric condition, this second record then being compared with the first mentioned record. This comparison may be made to produce a track error record which is then used in a track correction vehicle, or the track error signal may be generated in the track correction vehicle.

Alternatively, the step of obtaining a second record may be omitted, the desired geometric condition being immediately compared with the record representing the actual values of the track condition.

One way of obtaining the desired geometric condition is to compute electronically a running average value using, say, ten readings from the actual record representing track values at 2 meter intervals.

BRIEF DESCRIPTION OF THE DRAWINGS

The invention will now be described in greater detail with reference to the accompanying drawings, in which.

DESCRIPTION OF PREFERRED EMBODIMENT

Figure 1:
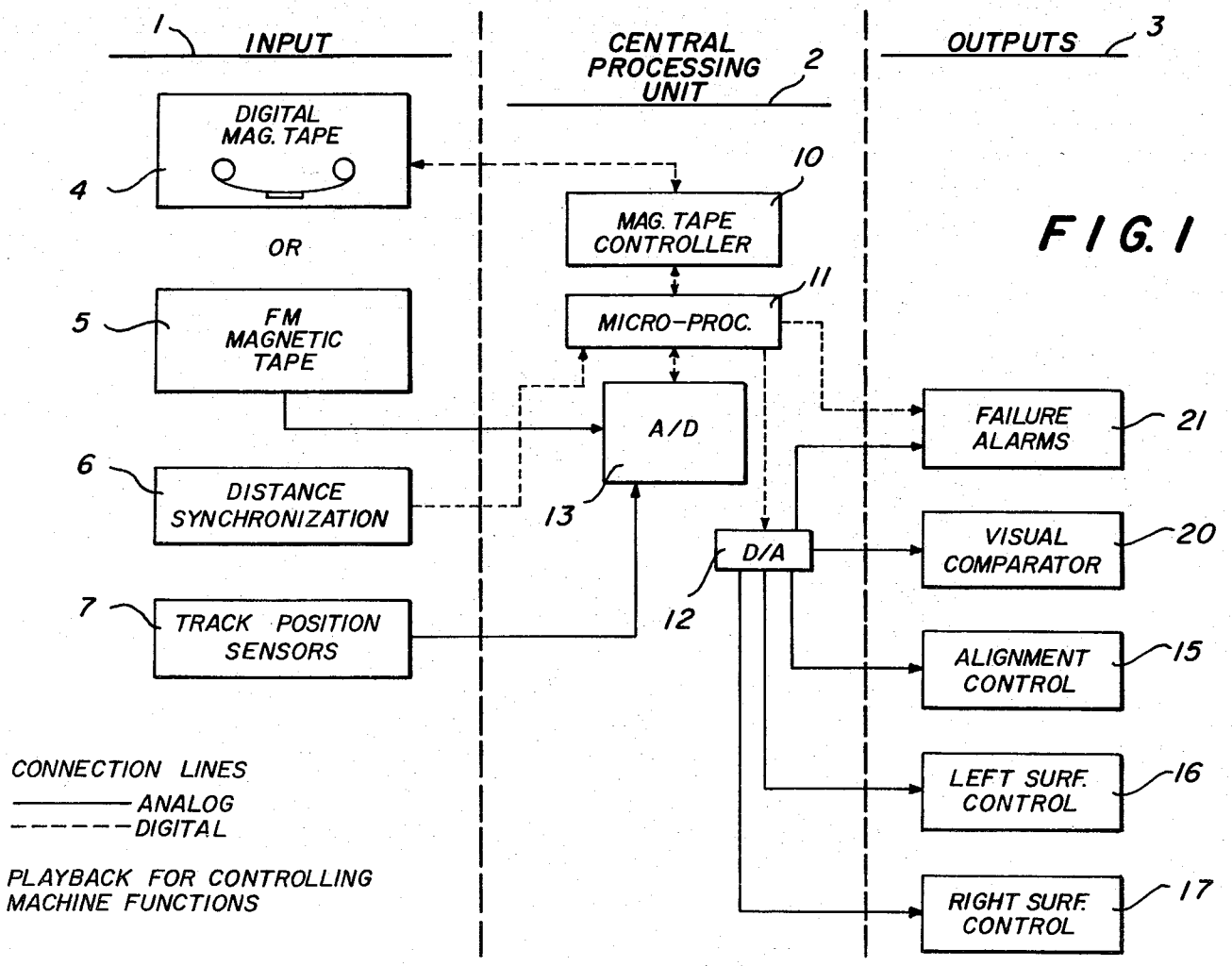
FIG. 1 is a block diagram illustrating schematically the general system of the present invention.

The components shown in FIG. 1 may be divided into three categories, namely input 1, central processing unit 2 and outputs 3. The main input may be a digital magnetic tape 4 or an FM magnetic tape 5. In either case the tape has been derived previously in a known manner from a known track recording car running over a particular section of track. Such a tape typically carries separate spaced tracks each carrying a record of a specific parameter indicative of the geometric condition of the track. Thus, the tape would have records of the alignment, left rail elevation, right rail elevation, cross level, etc.

Another input is obtained from a block 6 entitled distance synchronization which ensures that the information on the tape is processed in synchronism with the movement of a track correction vehicle which carries the apparatus of FIG. 1 over the section of track to be corrected. The track correction vehicle carries in a known manner hydraulic mechanisms for moving the track to the left or right and for raising the left and right rails independently. The block 7 entitled track position sensors symbolizes sensors which run on the rails and derive input signals corresponding to particular locations sensed on the track, for example crossings.

With reference to the central processing unit 2, a magnetic tape controller 10 under the control of a microprocessor 11 controls the running of the digital tape 4. The input from the distance synchronization is fed to the microprocessor 11 which causes the magnetic tape controller 10 to control the speed of the magnetic tape 4 according to the speed of the track correction vehicle so that the tape is unwinding in synchronism with the movement of the vehicle.

The digital information on the tape is read in the magnetic tape controller and passed to the microprocessor 11 which has been pre-programmed to derive a digital output signal representative of the difference between the data read at a particular point on the tape and data indicative of an ideal or preferred track condition. It should be understood that probably not all the recorded information on the tape would be read and, for the purpose of the present explanation, we will consider that the information which is being read is the track alignment record and the cross-level record. A digital output signal for the difference between the actual and preferred track alignment condition would, therefore, be obtained and further a digital output signal for the difference between the actual and preferred cross-level condition would therefore, be obtained. These digital output signals are fed to a digital/analog converter 12 to derive analog "error" signals for controlling the track correction mechanisms on the track correction vehicle.

The analog/digital converter 13 also shown as forming part of the central processing unit 2 is used to convert the analog input from the track position sensors 7 to digital form for handling by the microprocessor. The analog/digital converter 13 is also capable of providing suitable digital input if the track record is provided in the form of FM magnetic tape 5 rather than digital magnetic tape. The input from the track position sensors is processed in the microprocessor 11 which then alerts the track correction vehicle to stop at crossings, for example. The use of such track position sensors for this purpose is conventional and, accordingly, will not be described in any further detail.

The digital/analog converter 12 derives output signals corresponding to the deviation of the track from the preferred or ideal values in respect of the parameters of interest, in the present example alignment and cross-level. Thus a box 15 entitled alignment control symbolizes a servo-mechanism for driving the track alignment mechanism either right or left depending on the alignment error signal input from the digital analog converter. Two boxes 16 and 17 entitled left surface control and right surface control symbolize servo-mechanisms for driving lifting mechanisms for the left and right rails, respectively. If the cross-level "error" signal indicates that the left rail should be higher, then a signal appears at the input of the left surface control 16 causing the left rail to be lifted a certain amount, and, similarly, for an error signal indicating that the right rail should be higher, a signal appears on the input of the right surface control 17.

A visual comparator 20 may also be provided in the outputs 3 to give the operator a visual indication of, for example, the actual track condition, the preferred track condition and/or the error condition. The visual comparator could take the form of an oscilloscope to which signals from the microprocessor 11 and the digital analog converter 12 are applied as inputs, thus deriving on the oscilloscope screen three traces corresponding, respectively, to the actual track condition as recorded on the magnetic tape, the preferred track condition as obtained in the microprocessor and the "error" condition as obtained from the output of the digital/analog converter. Obviously, if a track error record is made independently from the track correction vehicle for use therein, the actual track condition and the preferred track condition could be dispensed with and only the error record would be displayed. Obviously the track alignment condition and/or the cross-level condition or any other parameter could be displayed either simultaneously or as alternatives.

The last box 21 in the outputs symbolizes failure alarms which would operate if there was a power failure or a failure in any portion of the central processing unit 2 such as the microprocessor 11 or digital/analog converter 12. The alarms would also be capable of signalling incorrect operation of the track position sensors 7. The alarms 21 would be arranged in known manner, on a console for monitoring by the operator.

Figure 2:
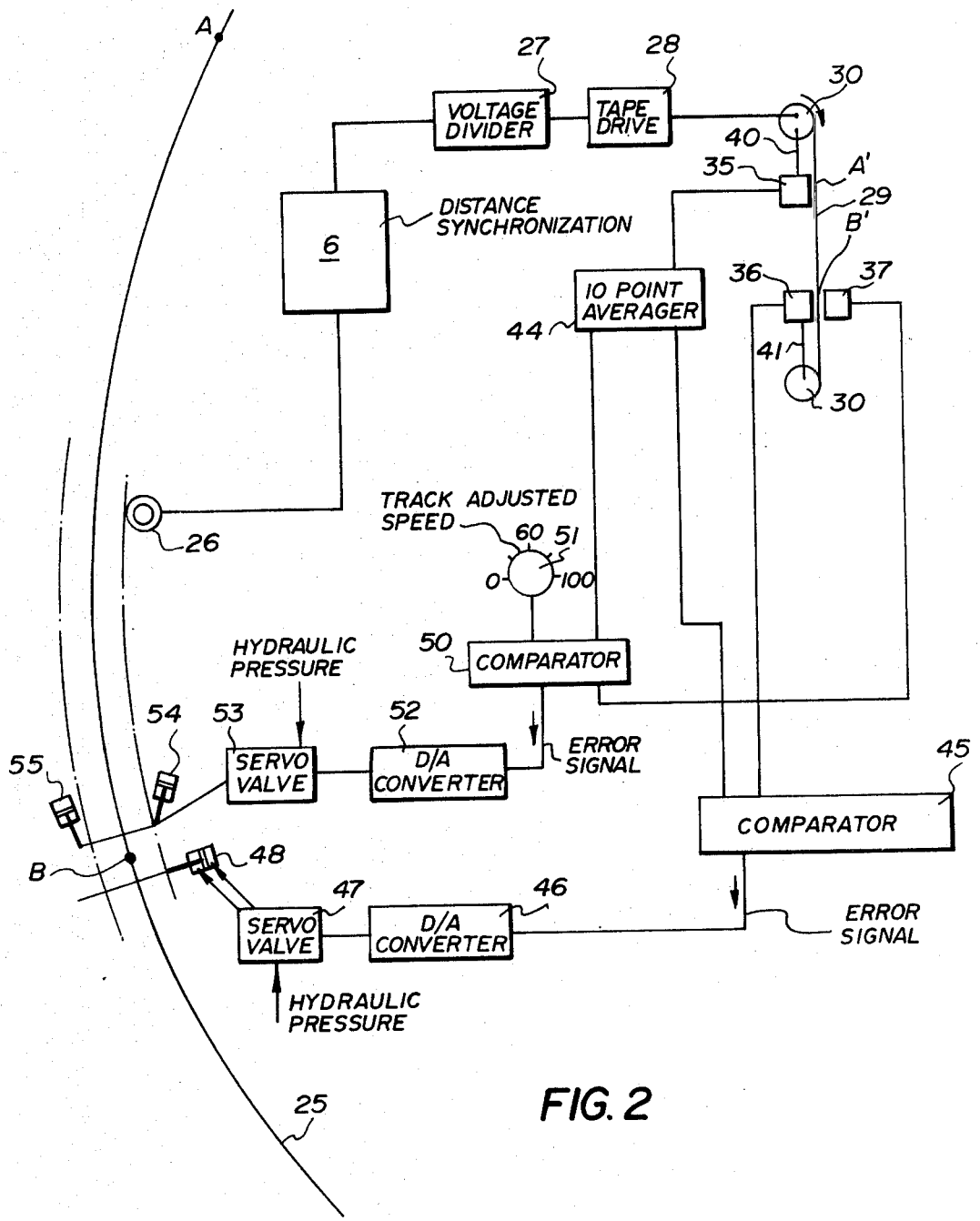
FIG. 2 is a schematic diagram of the invention as applied to a section of track and illustrating an exemplary embodiment of a central processing unit.

Turning now to FIG. 2, an example of how the microprocessor may be programmed to obtain a preferred track condition is illustrated. A portion 25 of a track which is to be corrected in alignment and cross-level is shown. The distance synchronization 6 is shown connected to a vehicle wheel 26 running on the track and may be in the form of a tachogenerator deriving a voltage dependent on the speed of the track correction vehicle. In that case, the output of the distance synchronization 6 is fed to a voltage divider 27 which derives an output voltage the magnitude of which is dependent on the voltage from the distance synchronization 6. The output voltage with appropriate amplification (not shown) is used to control the tape drive 28 which forms part of the magnetic tape controller 10 and which drives the magnetic tape 29 by means of sprockets 30 on which the tape is wound.

The magnetic tape controller 10 also includes two magnetic heads 35 and 36 spaced along the magnetic tape in the stretch between the two sprockets 30. The heads 35 and 36 are aligned with that magnetic track on the tape 20 which is the record of the railway track alignment. A further magnetic head 37 located at the same longitudinal position as head 36 is aligned with that magnetic track on the tape 29 which is the record of the railway track cross-level. The head 37 is shown facing the underside of the magnetic tape 29 for ease of illustration but it is to be understood that it would, in practice, be facing the same side of tape 29 as heads 35 and 36. The spacing between head 35 and heads 36 and 37 is chosen so that it corresponds to a desired length of track, say 10 meters. Thus, the points A and B on the track 25 would correspond to points A′ and B′ on the tape 29.

Connecting lines 40 and 41 are shown interconnecting sprockets 30 with heads 35 and 36 respectively and these are intended to indicate that the read heads are switched on at predetermined amounts of rotation of the sprockets 30 corresponding to predetermined lengths on the track, say 2 meters. Thus, the read heads 35 and 36 provide outputs which represent the geometric alignment condition at every 2 meters of the track length under investigation. The actual means by which the heads are switched on is not shown but it should be appreciated that this could take the form of a cam mounted on the sprocket 30 operating a follower to open and close a switch in the heads.

The microprocessor 11 includes a ten point averager 44 to which the outputs from head 35 are fed. The averager 44 includes a digital counter which sums every ten outputs and divides by ten to obtain an average digital value which represents the average misalignment or deviation over a twenty meter length. By successively dropping off the last input and adding a new input a running average is obtained and this is fed to the comparator 45 where it is compared with the outputs of the read head 36 which represents the actual values of track misalignment as measured from the tape 29. Because of the spacing chosen between heads 35 and 36, each reading obtained at head 36 is compared in comparator 45 with the average value of the readings corresponding to ten meters on each side of point B.

An error signal is derived in comparator 45, this error signal indicating digitally how much the track deviates from a preferred alignment condition (the average value). This error signal is converted in a digital/analog converter 46 to provide an analog voltage which drives a servo-valve 47 controlling a hydraulic jack 48 located at the point B which corresponds to the point B' on the tape 29. Thus, the jack 48 is moved to the right or left in accordance with the magnitude and sign of the analog error signal in a sense to reduce or remove the error. The digital/analog converter 46 is equivalent in function to digital analog converter 12 shown in FIG. 1 and the servo-valve 47 is equivalent to the alignment control 15 of FIG. 1.

Correction of the cross-level is obtained using as a starting point the following formula, according to the A.R.A. standard, for the superelevation of a railroad track where superelevation means the height of the outside rail on a curve above the inside rail. The formula is $E=0.0007V^2D$ where E=the superelevation in inches V=the proposed train speed in miles per hour, and D=the curvature of the track in degrees measured as the angle subtended by the radii from a 100 foot chord.

The output from the ten point averager 44 is obviously a measure of the track curvature and so this output is fed to a comparator 50.

A second input to the comparator 50 is derived from a track speed adjuster 51. If the proposed train speed is, for example, 60 miles/hr., this value is selected on the track speed adjuster 51 and an appropriate signal is fed into comparator 50.

A third input to comparator 50 is derived from read head 37 which, as stated above, is aligned with the cross-level magnetic record on tape 29. As with heads 35 and 36, head 37 is understood to be related to the angular position of sprockets 30 so that a reading is obtained every few cms or so corresponding to every 2 meters of the railroad track. The comparator compares the signals obtained from read head 37 with $0.0007V^2D$ obtained on the basis of the other two inputs and any resultant signal denotes the magnitude of the track super-elevation error. The error signal thus obtained as an output from comparator 50 is, of course, a digital signal and so a digital/analog converter 52 is provided to derive an output analog signal which drives a servo-valve to operate a hydraulic lifting jack 54 or 55, both located at point B, depending on which rail has to be lifted to remove the error signal.

When the track correction machine is operating on a straight section of track the value for D is, of course zero, and therefore the computed value $0.0007V^2D$ representing superelevation is zero. Thus the cross-level should also be zero, i.e. both rails at same height, on straight track. If the cross-level as indicated by read head 37 is not zero for a straight section of track the signal obtained from servo-valve 53 controls the jacks 54 and 55 so as to reduce the cross-level towards zero.

As a modification of the above system, it is envisaged that, instead of using a single tape containing the actual record from which, using the ten point averager 44, a preferred or desired condition is obtained and simultaneously compared with the actual values on the tape, two tapes may be used, one bearing the actual record of the track condition and the other bearing the desired condition. The second tape would have been obtained at some earlier stage by processing the first tape using, for example, a read head a ten point averager and a write head.

The two tapes would, in the track correction machine, be run in synchronism and there would be two read heads, one for each tape, both corresponding to read head 36. Thus, the comparator 45 would have an input from one read head as before indicating the actual track condition and, instead of an input from a ten point averager, the second input would come directly from the other read head reading the second tape.

A further modification of the above system can be employed wherein the tape containing the actual record is used with a ten point averager 44 to create a preferred or desired condition signal which is compared with the actual record to create a single tape of track error to be used on the track correction machine which would be driven in synchronism with the reading of the single tape of track error.

It will be appreciated that the original tape bearing a record of the track condition was obtained from a recording car operating at a particular speed and axle loading over the section of track of interest. It can be appreciated that the record obtained may, therefore, be dependent on these two parameters and so it might be useful to try to ensure that the speed and axle loading of the recording car are similar to the speed and axle loading expected in normal operation of the track. It may also be useful to obtain several tapes representing track conditions for several different axle loadings and/or vehicle speeds in the event that it expected that the track will be used over a range of axle loadings and/or speeds. In this case, it is envisaged that the several tapes will be run simultaneously and the average value of the several records at each point obtained. The average values of the several records would then be ten point averaged as before to provide a running average which would be compared with the "actual" average value of the several records. This averaging and subsequent ten point averaging could conceivably be done directly from the several tapes carried in the track correction vehicle but it is more likely that the several tapes would be used to provide a first "master" tape representing the average at each point of the several tapes and a second "master" tape representing the ten point averaged version of the first "master" tape. The two "master" tapes would then be processed in the track correction vehicle as described in the modification of the preceeding paragraph.

As a further modification of the basic system, the magnetic tape 29 would be used to obtain the desired or preferred geometric condition of the track but would not be used to provide the actual geometric condition of the track for comparison with the desired condition. In other words, the read heads 36 and 37 would not be used to pick off values for actual alignment and cross-level. The actual values would be obtained directly by the track correction vehicle using known measuring systems for measuring the alignment and cross-level of the track and sampling the actual measurements obtained every two meters. The sampled values of track alignment and cross-level would then be fed into comparators 45 and 50, respectively. This modified system could therefore be considered as a hybrid of the basic system described above in which the original tape provides all the data necessary for track correction and the system described in U.S. application Ser. No. 844,819 filed Oct. 25, 1977 now U.S. Pat. No. 4,176,456 and U.S. application Ser. No. 862,852 filed Dec. 2, 1977 now U.S. Pat. No. 4,166,291 in which all the data necessary for track correction is provided by track measuring systems.

It should be appreciated that the reason for averaging ten (or so) alignment readings in the ten point average 44 is to provide an acceptable datum on a curved section of track from which to measure the alignment deviation of the track. An error signal can then be generated as described above. However, on straight sections of track the datum for measuring the deviation is obviously a straight line so that for straight sections it is not necessary to generate a datum by averaging. Thus, the information on the digital tape 4 could, for straight sections of track, be used directly as to error signal.

Although preferred embodiments of the invention have been described, numerous modifications and alterations thereto would be apparent to one skilled in the art without departing from the spirit and scope of the present invention.

What we claim as our invention is:

1. A method of correcting railroad track comprising obtaining a first record on a recording medium representing the actual geometric condition of at least one parameter of a length of track under speed and axle loading conditions similar to expected speed and axle loading conditions when the track is in normal operation, reading the record in a track correction vehicle moving along the track and at a speed corresponding to the speed of the track correction vehicle, the reading of the record being at a rate such that the part of the record being read at any given instant is the record for the track at the position of the track correction vehicle on the track at that instant, and deriving from the record electrical error signals indicative of the difference between the actual geometric condition and the desired geometric condition and using the error signals to control track moving means on the track correction vehicle in a direction to reduce the difference.

2. A method according to claim 1, in which the error signals are derived by comparing the actual geometric condition with the desired geometric condition in an electronic comparator contained in the track correction vehicle.

3. A method according to claim 2, in which, for correcting alignment, the desired geometric condition is obtained by computing electronically from the first record a running average value which is then immediately compared with the actual geometric condition on the first record.

4. A method according to claim 3, in which the running average value is obtained using at least ten readings from the first record.

5. A method according to claim 2, in which the desired geometric condition is provided as a second record, the second record being compared with the first record.

6. A method according to claim 5 in which for correcting alignment the second record is obtained by previously computing from the first record a running average value.

7. A method according to claim 1 in which the first record is an actual record of the track error whereby the record is converted directly to the electrical error signals.

8. A method according to claim 1 in which a plurality of records are first obtained, each representing the actual geometric condition of the same length of track under different dynamic loading conditions, the plurality of records being averaged to provide the first record.

9. A track correction vehicle for correcting at least one parameter of a length of track, comprising a record reading system adapted to read a first record on a recording medium representing the actual geometric conditions of at least one parameter of a length of track, the record reading system having record drive means synchronized with the vehicle speed, an upstream and a downstream read head mutually spaced a predetermined distance along the direction of travel of the recording medium which distance corresponds to a predetermined length of track, means for sampling at both heads the alignment record at predetermined intervals, the upstream read head having an output connected to an averaging circuit which derives at an output thereof a running average of a plurality of samples; and a comparator to which the output of the averaging circuit and an output of the downstream read head are connected to and which derives electrical error signals indicative of the difference between the actual geometric conditions and the desired geometric conditions and the desired geometric condition are derived, and track moving means operable under control of the electrical error signals to move the track in a direction to reduce the difference.

10. A track correction vehicle according to claim 9 comprising a further read head adjacent the downstream read head for alignment with the cross-level record, the further read head having an output providing samples of cross-level readings at predetermined intervals to a further comparator, an output of the averaging circuit also being connected to the further comparator in which values of superelevation corresponding to track curvature are obtained and compared to the cross-level samples to derive error signals, and means for raising one rail relative to the other under the control of the error signals to achieve the correct superelevation.

* * * * *